United States Patent [19]

Mushardt et al.

[11] Patent Number: 4,945,888

[45] Date of Patent: Aug. 7, 1990

[54] METHOD OF DRESSING GRINDING WHEELS

[75] Inventors: Heinrich Mushardt, Neu-Börnsen; Uwe Uhlig, Buchholz; Peter Lütjens, Hamburg; Horst Beyer, Hamburg; Frank Matysick, Hamburg, all of Fed. Rep. of Germany

[73] Assignee: Körber AG, Hamburg, Fed. Rep. of Germany

[21] Appl. No.: 227,238

[22] Filed: Aug. 2, 1988

[30] Foreign Application Priority Data

Aug. 4, 1987 [DE] Fed. Rep. of Germany ..... 3725776

[51] Int. Cl.[5] ..... B24B 53/06

[52] U.S. Cl. ..... 125/11.15; 51/325

[58] Field of Search ..... 51/283 R, 165.8, 165.71, 51/165.75, 165.77, DIG. 14, 325; 125/11 A, 11 AT, 11 B, 11 M, 11 NT

[56] References Cited

U.S. PATENT DOCUMENTS

| | | | |
|---|---|---|---|
| 2,608,033 | 8/1952 | Morris | 125/11 A |
| 4,020,820 | 5/1977 | Kish | 51/283 X |
| 4,085,554 | 4/1978 | Sugita | 51/325 |
| 4,262,456 | 4/1981 | Haug | 51/325 |
| 4,274,231 | 6/1981 | Verega | 51/325 X |
| 4,274,388 | 6/1981 | Ivel | 51/325 X |
| 4,490,946 | 1/1985 | Tsujiuchi et al. | 51/165.77 X |
| 4,501,092 | 2/1985 | Archibald | 51/165.71 X |
| 4,539,779 | 9/1985 | Donner | 51/325 |
| 4,570,389 | 2/1986 | Leitch et al. | 51/325 |

FOREIGN PATENT DOCUMENTS

| | | | |
|---|---|---|---|
| 2327846 | 12/1973 | Fed. Rep. of Germany | 125/11 A |
| 0168470 | 7/1986 | Japan | 51/165.71 |
| 1362691 | 8/1974 | United Kingdom | 125/11 A |

*Primary Examiner*—Robert P. Olszewski

*Attorney, Agent, or Firm*—Peter K. Kontler

[57] ABSTRACT

The sharpness profile of the working surface of a grinding wheel is determined in the course of a dressing operation by controlling the velocity of movement of the point of contact between the dressing tool and the grinding wheel. The velocity of such movement can be varied by changing the velocity of movement of the grinding wheel in a direction at right angles to its axis and/or by changing the velocity of movement of the dressing tool in a direction which is parallel to the axis of the grinding wheel. The velocity of the point of contact is varied as a function of changes of the inclination of various sections of the working surface relative to the axis of the grinding wheel. This influences the depth of notches or grooves which are formed by a rounded portion of the dressing tool in the working surface of the grinding wheel. The depth of such notches determines the sharpness of the corresponding sections of the working surface.

11 Claims, 3 Drawing Sheets

MOTOR
MOTOR
POSITION MONITORING DEVICES
INPUT UNIT
INPUT ASSEMBLIES
CORRECTING CIRCUIT
PROCESSOR
MEMORY
ADJUSTING CIRCUIT
ADJUSTING CIRCUIT
AMPLIFIER
AMPLIFIER
FUNCTION GENERATOR
INTER-POLATOR
POSITION REGULATORS
CONTROL CIRCUIT

METHOD OF DRESSING GRINDING WHEELS

BACKGROUND OF THE INVENTION

The invention relates to a method of dressing grinding wheels in grinding machines. More particularly, the invention relates to improvements in methods of for path-controlled dressing of rotary grinding wheels so as to impart to the working surfaces of grinding wheels a predetermined sharpness profile. Still more particularly, the invention relates to improvements in methods of dressing grinding wheels in a machine wherein the dressing tool and the grinding wheel are caused to move relative to each other in directions which extend transversely of one another and the dressing tool is in point contact with the working surface of the grinding wheel in the course of the dressing operation.

Dressing of grinding wheels is necessary in order to impart to the working surface of the grinding wheel an optimum configuration (profile) as well as to ensure that the condition of the working surface will be best suited for carrying out one or more grinding operations. Two very important parameters of a properly dressed grinding wheel are the configuration and the sharpness of its working surface, i.e., of that surface which comes into contact with workpieces during grinding in a grinding machine. The dressing parameters should be selected in such a way that the number as well as the distribution of active cutting edges in the working surface of the dressed grinding wheel (i.e., the sharpness of the grinding wheel) will be best suited for carrying out one or more satisfactory grinding operations. The quality of the dressing operation depends to a considerable degree upon the rate of infeed of the dressing tool and on the extent of overlap of the dressing tool with the working surface of the grinding wheel. If the dressing tool is a diamond roll, the quality of dressing operation is further influenced by the rotational and peripheral speeds of the selected diamond roll.

OBJECTS OF THE INVENTION

An object of the invention is to provide a method of dressing relatively simple or relatively or highly complex grinding wheels in such a way that the sharpness profile of the working surface of the dressed grinding wheel will match or closely approximate a desired sharpness profile.

Another object of the invention is to provide a method which renders it possible to automatically eliminate deviations from the optimum path of movement of the dressing tool relative to the grinding wheel and/or vice versa during dressing so as to ensure that the actual sharpness profile does not deviate from the desired sharpness profile.

A further object of the invention is to provide a method which renders it possible to properly dress a grinding wheel whose working surface has a number of sections with widely different inclinations relative to the axis of the grinding wheel.

An additional object of the invention is to provide a method which can be carried out in existing grinding machines and with existing dressing apparatus upon completion of relatively small changes in the construction and mode of operation of such machines and apparatus.

Still another object of the invention is to provide a novel and improved method of path-controlled dressing of rotary grinding wheels having working surfaces with sections which are parallel to as well as with sections which are slightly or strongly inclined relative to the axis of the grinding wheel.

SUMMARY OF THE INVENTION

The invention resides in the provision of a method of imparting to the working surface of a grinding wheel a predetermined sharpness profile in the course of path-controlled dressing of the working surface with a dressing tool which contacts the working surface in the course of the dressing operation. The method comprises the steps of rotating the grinding wheel about its axis, moving the grinding wheel and the dressing tool in a first direction and in a second direction substantially transversely of the first direction, and varying the velocity of movement in at least one of the first and second directions in accordance with a predetermined pattern. One of the directions preferably has a component which is parallel to the axis of the grinding wheel. In accordance with a presently preferred embodiment, the dressing tool is moved in parallelism with the axis of the grinding wheel and the grinding wheel is moved at right angles to its axis.

The working surface of the grinding wheel is normally in a mere or substantial point contact with the dressing tool in the course of the dressing operation, and the moving step preferably includes varying the velocity of movement of the point of contact between the working surface and the dressing tool along the path of movement of such point of contact in the course of the dressing operation.

The varying step includes varying the velocity of movement in the at least one direction as a function of the configuration (profile) of the working surface of the grinding wheel.

If the working surface of the grinding wheel has a section which is inclined relative to the axis of the grinding wheel, the varying step can include varying the velocity of movement in the at least one direction as a function of the extent of inclination of the section of the working surface relative to the axis of the grinding wheel. Such varying step includes increasing the velocity of movement in the at least one direction when the extent of inclination of the section of the working surface increases and vice versa.

In accordance with a presently preferred embodiment of the method, the axis of the grinding wheel is parallel to the second direction and the varying step includes varying the velocity of relative movement of the grinding wheel and dressing tool in the first direction (especially at least substantially at right angles to the axis of the grinding wheel).

The method can include the steps of selecting a predetermined path of movement for the point of contact between the working surface of the grinding wheel and the dressing tool in the course of the dressing operation, generating signals which denote the predetermined path and regulating the moving step in the at least one direction as a function of such signals. This method can further comprise the steps of monitoring the relative movements of the grinding wheel and dressing tool to ascertain the actual path of movement of the point of contact between the working surface of the grinding wheel and the dressing tool on the basis of results of the monitoring step, comparing the predetermined path with the actual path and generating correction signals which denote deviations of the actual path from the predetermined path. The regulating step includes adjusting the varying step as a function of the correction signals so as to eliminate the deviations.

If one or more sections of the working surface of the grinding wheel have a pronounced inclination relative to the axis of the grinding wheel, the method preferably further comprises the step of changing the orientation of the dressing tool relative to the grinding wheel (and/or vice versa) during dressing of such section or sections of the working surface. If the dressing tool has a flank which makes with the just discussed steep section or sections of the working surface a predetermined angle prior to the orientation changing step, the orientation changing step includes increasing the angle so that the thus increased angle exceeds a preselected minimum value.

The novel features which are considered as characteristic of the invention are set forth in particular in the appended claims. The improved method itself, however, together with additional features and advantages thereof, will be best understood upon perusal of the following detailed description of certain specific embodiments with reference to the accompanying drawing.

DESCRIPTION OF PREFERRED EMBODIMENTS

Figure 1:
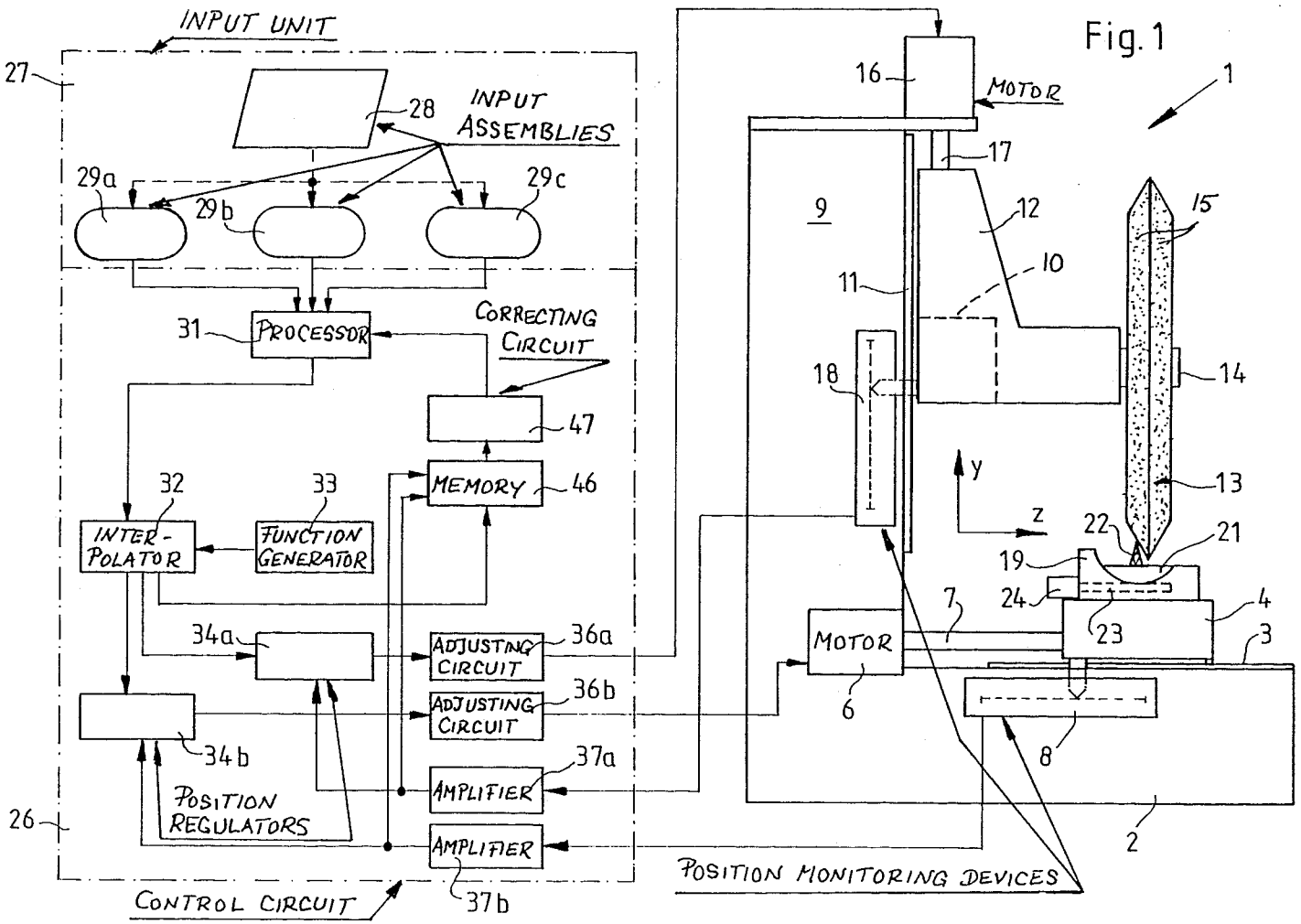
FIG. 1 is a schematic elevational view of a grinding machine which embodies an apparatus, for the practice of the improved method the control means of the machine being shown in the form of a block diagram.

FIG. 1 shows certain parts of a profile grinding machine 1 which is illustrated in a side elevational view and is not drawn to scale. The machine 1 comprises a base or bed 2 which is provided with horizontally extending guide means or tracks 3 for a table 4 forming part of a dressing apparatus 19 and constituting a carrier means for a dressing tool 22. The table 4 is reciprocable in and counter to the direction which is indicated by arrow Z by a moving means 6 constituting or including a variable-speed motor operatively connected with the table 4 by a rotary feed screw 7. The path of the carrier means or table 4 along the tracks 3 is a horizontal path. A measuring or monitoring device 8 of known design is provided to monitor successive stages of movement of the table 4 relative to the base 2 and to generate corresponding signals which thus denote the positions of the dressing tool 22 during various phases of a dressing operation.

The grinding machine 1 further includes a column 9 which is provided with vertical guide means or tracks 11 for a wheelhead 12 constituting a means for supporting a grinding wheel 13 whose horizontal axis of rotation 38 (FIG. 2) coincides with the axis of a tool spindle 14 which is rotatably journalled in the wheelhead 12 and can receive torque from a suitable motor 10. The means for moving the wheelhead 12 and the grinding wheel 13 in and counter to the direction which is indicated by an arrow Y (namely transversely of the direction which is indicated by the arrow Z) includes a variable-speed motor 16 which is operatively connected with the wheelhead 12 by a rotary feed screw 17. A second measuring or monitoring device 18 is provided on the column 9 to generate signals which are indicative of successive stages of movement of the wheelhead 12 and grinding wheel 13 during different phases of the dressing operation which involves imparting to the working surface 15 of the grinding wheel 13 a predetermined sharpness profile.

The carrier means or table 4 of the dressing apparatus 19 is provided with a holder or bearing 21 which forms part of a means for tilting the dressing tool 22 relative to the table 4 about an axis which is normal to the axis 38 (FIG. 2) of the grinding wheel 13 and extends at right angles to the plane of FIG. 1. The means for tilting the dressing tool 22 about such axis further includes a reversible electric motor 24 and a feed screw 23 which establishes an operative connection between the motor 24 and the holder 21.

The grinding machine 1 further comprises a control unit 26 which is connected with an input unit 27. The latter comprises an input assembly 28 for workpiece data such as the dimensions, profile, shape, surface finish and other parameters. The unit 27 further comprises three additional input assemblies 29*a*, 29*b* and 29*c*. The assembly 29*a* furnishes data pertaining to the profile, diameter and other parameters of the grinding wheel 13 which happens to be mounted on the spindle 14, the assembly 29*b* furnishes data pertaining to the dressing tool 22 which is to be used to treat the working surface 15 of the grinding wheel 13 on the spindle 14, and the assembly 29*c* contains data pertaining to certain additional dressing parameters including the rate of infeed, other movements, and so forth. The information which is contained in the input unit 27 can be transmitted to the control unit 26. The control unit 26 comprises a processor 31 whose output or outputs transmit signals serving to ensure proper grinding of a workpiece (not shown) which is mounted on its work holder and is to be treated by the properly dressed grinding wheel 13. Such treatment involves rotation of the grinding wheel 13 about its axis 38 and feeding of the grinding wheel and/or of the workpiece in the direction of one or more axes including the X-axis (not shown), the Y-axis and the Z-axis in a manner well known from the art of grinding workpieces in numerically controlled grinding machines.

The output of the processor 31 of the control unit 26 is connected with one input of an interpolator 32 another input of which is connected with a function generator 33. The operation of the function generator 33 will be described hereinafter with reference to FIG. 2. Two outputs of the interpolator 32 are connected with the corresponding inputs of two position regulators 34*a*, 34*b* which control the motors (moving means) 16 and 6 through the medium of adjusting circuits 36*a*, 36*b*, respectively. As explained above, the motor 16 can move the wheelhead 12 and the grinding wheel 13 on the spindle 14 in and counter to the direction which is indicated by the arrow Y, and the motor 6 can move the carrier or table 4 with the dressing tool 22 in and counter to the direction which is indicated by the arrow Z.

The measuring or monitoring device 8 transmits to an amplifier **37*b* signals which denote the momentary positions of the table 4, and such signals are transmitted to the position regulator 34*b*. The position regulator 34*a* receives (by way of an amplifier 37*a*) signals which are transmitted by the measuring or monitoring device 18 and denote the momentary positions of the wheelhead 12 and grinding wheel 13. This completes the position regulating circuits for movements of the grinding wheel 13 and the dressing tool 22** in the respective directions.

Figure 2:
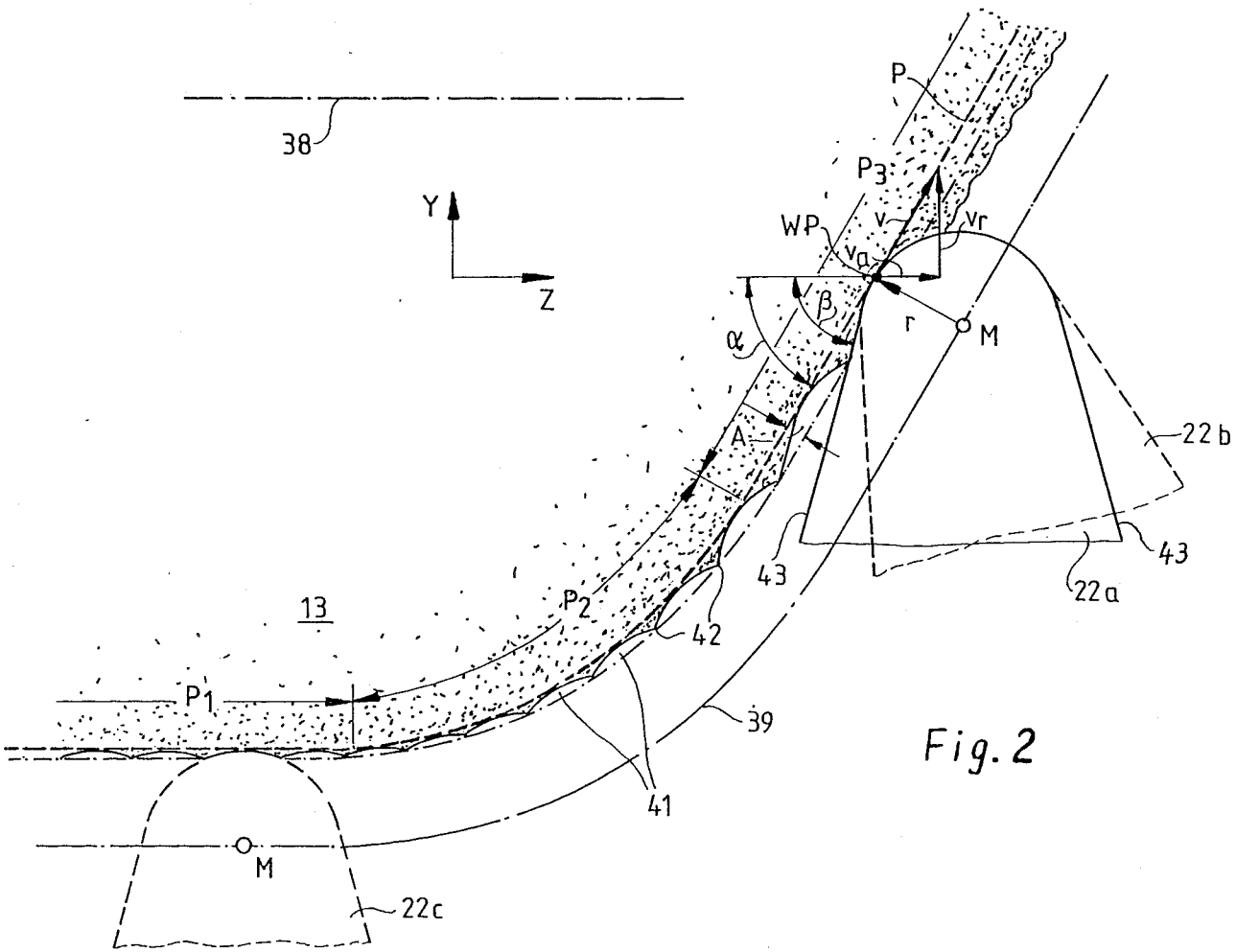
FIG. 2 is a greatly enlarged axial sectional view of a portion of a grinding wheel which can be dressed in accordance with the method of the present invention, different positions of the dressing tool in the course of the dressing operation being shown by broken and solid lines.

FIG. 2 shows, drawn to a greatly enlarged scale, a portion of a grinding wheel 13 which can be dressed in accordance with the method of the present invention. The desired configuration or profile P of the working surface 15 of the grinding wheel 13 which is shown in FIG. 2 is obtained upon completed dressing of a first section P1 which is parallel to the axis 38 of rotation of the grinding wheel 13 (such axis coincides with the axis of the spindle 14 when the grinding wheel is properly mounted on the wheelhead 12), a second section P2 which has an arcuate shape and whose inclination relative to the axis 38 gradually increases in a direction from the adjacent end of the section P1 toward the adjacent end of a third section P3 whose inclination relative to the axis 38 is constant or nearly constant and can match the maximum inclination of the section P2. The angle $\alpha$ denotes the inclination of the sections P1, P2 and P3 relative to the axis 38. Thus, the angle $\alpha$ equals zero for the section P1, such angle increases gradually for the section P2, and such angle is constant for the section P3 of the configuration or profile of the working surface 15.

The dressing tool 22 which is shown in FIG. 2 has a profile which is composed of a partly circular portion having a radius $\underline{r}$ and a center of curvature at M, and two straight flanks 43 which are disposed at opposite sides of the partly circular portion. The dressing tool 22 can be tilted (by the motor 24, feed screw 23 and holder 21) about an axis which is normal to the plane of FIG. 2 and includes the center of curvature M. The angle $\beta$ denotes the inclination of the left-hand flank 43 of the dressing tool 22 relative to the axis 38 of the grinding wheel 13 when the dressing tool is held in the solid-line position **22*a* or in the broken-line position 22*c***.

The center of curvature M is to move along a path 39 in order to impart to the working surface 15 a predetermined optimum sharpness profile and to impart to the working surface 15 the optimum or desired configuration or profile P.

When the motor 10 is on to rotate the grinding wheel 13 of FIG. 2 about its axis 38 and the dressing tool 22 is moved from the broken-line position **22*c* toward the solid-line position 22*a*, the circular portion of the profile of the dressing tool 22 provides the working surface 15 of the grinding wheel 13 with notches or grooves 41 which have a depth A and are inclined relative to the axis 38 of the grinding wheel. The notches or grooves 41 are bounded by cutting edges 42 which determine the sharpness of the dressed working surface 15. If the depth A of the notches or grooves 41 is pronounced, the mutual spacing and the sharpness of the cutting edges 42 is increased, and the grinding forces are reduced. If the velocity $\underline{v}$ of movement of the point WP of contact between the profile of the dressing tool 22 and the working surface 15 of the grinding wheel 13 is constant, the depth of the grooves or notches 41 rapidly decreases in response to an increase of the angle $\alpha$ of inclination of the momentarily dressed section of the working surface 15 relative to the axis 38 of the rotating grinding wheel 13. If the inner radius of the profile of the grinding wheel is small or very small, the depth A of the grooves or notches 41** is also very small.

The velocity of the point WP of contact between the dressing tool 22 and the working surface 15 of the grinding wheel 13 which is being dressed while it rotates about the axis 38 is composed of the velocity $v_a$ in the direction of the arrow Z and the velocity $v_r$ in the direction of the arrow Y. This is shown in FIG. 2 in the form of a vector diagram. Thus, the velocity $\underline{v}$ of movement of the point WP of contact along its path can be regulated by appropriate variation of the velocity $v_a$ and/or $v_r$.

In accordance with the method of the present invention, the velocity $\underline{v}$ of the point WP of contact between the working surface 15 and the dressing tool 22 is varied as a function of changes of the angle $\alpha$ between the axis 38 of the grinding wheel 13 which is being dressed and the tangent to the profile of the grinding wheel 13 at the point WP. This ensures that the working surface 15 of the dressed grinding wheel 13 exhibits a desired sharpness profile. Thus, by properly varying the velocity $\underline{v}$ (this includes varying the velocity va and/or the velocity $v_r$), selected sections of the working surface 15 of the dressed grinding wheel 13 can exhibit different sharpness profiles. This, in turn, ensures that the grinding operation which is carried out with such grinding wheel can be more accurately controlled and that the results of grinding (including the dimensions, shape and surface finish of the workpieces) match or very closely approximate the desired optimum parameters.

The means for varying the velocity $\underline{v}$ of the point WP in the course of the dressing operation includes the aforementioned interpolator 32 and function generator 33. The function generator 33 stores information pertaining to the velocity $\underline{v}$ of the point WP for each section of the working surface 15 and ensuring that the sharpness profile of the respective section of the working surface matches the desired value. The function generator 33 calculates, in dependency upon the magnitude of the angle $\alpha$, correction values for the velocities $v_a$ and $v_r$, and such information is transmitted to the interpolator 32 which transmits appropriate signals to the position regulators **34*a* and 34*b* for the circuits 36*a* and 36*b*, i.e., to the controls for the variable-speed motors 16 (wheelhead 12 and grinding wheel 13) and 6 (carrier or table 4 and dressing tool 22). The interpolator 32 calculates in advance the velocities for the next-following stages of movement of the point WP where the dressing tool 22 engages the working surface 15 of the rotating grinding wheel 13. In other words, the interpolator 32 transmits signals which are used to determine the immediately following movements of the point WP to its successive intermediate positions in the course of the dressing operation. For this purpose, the interpolator 32 processes information which is furnished by the processor 31 and by the function generator 33 of the control unit 26**. The velocity $\underline{v}$ of the point WP is a function of the velocities $v_a$ and $\bar{v}_r$.

By way of example, the dressing sections P1, P2 and P3 of the working surface 15 of the grinding wheel 13 which is shown in FIG. 2 can be carried out as follows: The angle $\alpha$ for the section P1 equals zero because the section P1 is at least nearly parallel to the axis 38 of the grinding wheel 13. As pointed out above, a portion of the grinding wheel 13 is shown in FIG. 2 in a greatly enlarged view, and the working surface 15 of this grinding wheel may but need not be identical with the working surface of the grinding wheel of FIG. 1. If the two grinding wheels are identical, the section P1 of FIG. 2 is or can be located in the region of the maximum-diameter portion of the working surface 15 of the grinding wheel 13 of FIG. 1. During dressing of the section P1, the point WP is caused to advance at a constant velocity $\underline{v}$ so that the circular portion of the dressing tool 22 provides the working surface 15 with notches or grooves 41 of corresponding depth A which matches a predetermined value and causes the formation of an optimum section of the sharpness profile of the working surface 15. The velocity $\underline{v}$ of the point WP is continuously and gradually increased during dressing of the section P2 as a function of the increase of the angle $\alpha$ between the tangent to the point WP and the axis 38 of the grinding wheel 13. This entails a deepening of the notches or grooves 41 and the formation of higher (more pronounced) cutting edges 42. Thus, the sharpness of the corresponding section of the working surface 15 increases proportionally with the increasing angle $\alpha$. Since the inclination of the section P3 relative to the axis 38 is constant, the velocity $\underline{v}$ of the point WP is constant but is higher than the velocity of the point WP during dressing of the section P1. The velocity $\underline{v}$ during dressing of the section P3 can match or approximate the maximum velocity $\underline{v}$ during dressing of the section P2.

If the section P3 is so steep that the angle $\alpha$ equals or approximates the angle $\beta$ between the axis 38 and the left-hand flank 43 of the dressing tool 22 which is shown in FIG. 2, the flank 43 is likely to remove portions of cutting edges 42 which are formed by the circular portion of the profile of the dressing tool 22. This would entail a reduction of the sharpness of the corresponding section of the dressed working surface 15. In order to prevent such reduction of sharpness, the motor 24 of the means for tilting the dressing tool 22 receives a signal to change the orientation of the dressing tool so that the dressing tool is tilted from the position 22*a* to the position 22*b* of FIG. 2 in order to increase the difference $\beta-\alpha$ so that such difference remains above a predetermined minimum value which is necessary to prevent the left-hand flank 43 from removing portions of cutting edges 42 during dressing of the section P3. The angle $\beta-\alpha$ can be said to constitute a relief or clearance angle which should not decrease below the predetermined minimum value if the left-hand flank 43 is to be reliably prevented from removing or reducing the sharpness of some of the cutting edges 42 which are formed by the circular portion of the profile of the dressing tool 22 during dressing of the section P3 or any other section whose inclination (angle $\alpha$) relative to the axis 38 approaches the angle $\beta$.

The improved method and apparatus renders it possible to properly dress a grinding wheel 13 with a view to ensure that all sections of the dressed working surface 15 will exhibit a desired optimum sharpness profile as a result of programmed variation of the velocity $\underline{v}$ of the point WP of contact between the dressing tool 22 and the working surface, i.e., as a result of programmed variation of the velocity of the dressing tool relative to the grinding wheel and/or vice versa.

Figure 3:
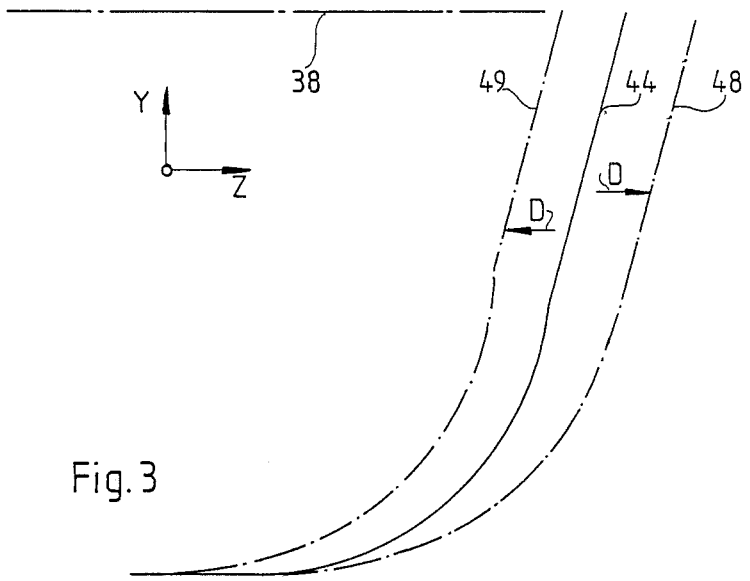
FIG. 3 is a diagram showing the manner of correcting the path of movement of the point of contact between the working surface of a grinding wheel and a dressing tool in the course of the path-controlled dressing operation.

The desired or optimum profile of the working surface of a properly dressed grinding wheel is shown in FIG. 3 by a solid line 44. This line denotes the desired path of movement of the point WP of contact between the working surface and the dressing tool in the course of the dressing operation. The purpose of the measuring or monitoring devices 8 and 18 is to ascertain the positions of the dressing tool (in the direction of the arrow Z) and the positions of the grinding wheel (in the direction of arrow Y) during each of a series of successive stages of the dressing operation. The information which is gathered by the monitoring devices 8 and 18 is transmitted in the form of appropriate signals to a memory 46 of the control unit 26 by way of the aforementioned amplifiers 37*b* and 37*a*. The memory 46 further contains information pertaining to desired positions of the dressing tool 22 and grinding wheel 13 during successive stages of the grinding operation. The information pertaining to the actual and desired positions of the dressing tool and grinding wheel during successive stages of the grinding operation is transmitted to a correcting circuit 47 wherein the information is compared and which transmits appropriate correction signals denoting the deviations D (if any) between the desired progress of the point WP (line 44) and the actual progress of the point WP (line 48 in FIG. 3). The correction signals are transmitted to the processor 31 which effects an appropriate correction of information which is transmitted to the interpolator 32 so that the deviations D are eliminated and the path which is denoted by the line 44 is the actual path of the point WP. The corrected signals for controlling the movements of the dressing tool 22 and grinding wheel 13 are indicative of a path of movement as denoted by the phantom line 49 in FIG. 3. Such correction (by signals from the circuit 47) of data which the processor 31 receives from the input unit 27 ensures that the deviations D are eliminated and the configuration or profile of the dressed working surface of the grinding wheel matches the desired or ideal profile P. The control unit 26 preferably memorizes the information which is transmitted by the circuit 47 so that such information can be used again during the next following dressing or dressings of the same grinding wheel.

The velocity $\underline{v}$ of the point WP of contact between the dressing tool 22 and a grinding wheel 13 can be properly controlled by varying the velocity $v_a$ and/or by varying the velocity $v_r$. Thus, it suffices to vary one of the velocities $v_a$ and $v_r$. For example, the velocity $v_a$ in the direction of the arrow Z can remain constant while the varying means 34*a* and 36*a* vary the speed of the motor 16 and hence the velocity $v_r$ of the wheelhead 12 and grinding wheel 13 along the tracks 11 (arrow Y). The velocity $v_r$ is altered as a function of changes of the angle $\alpha$. Such mode of operation renders it possible to simplify the control unit 26 without affecting the quality of sharpness profile of the dressed working surface 15.

The block diagrams of the control unit 26 and input unit 27 are shown in such form for the purpose of facilitating the description of the mode of operation of the grinding machine in the course of a dressing operation. In a modern grinding machine, the control and input units of the improved apparatus are combined into an integrated circuit which does not consist of discrete processors, interpolators and other parts of the units 26, 27 shown in FIG. 1 but performs all of their functions with the same result.

An important advantage of the improved method is that the sharpness profile of the dressed working surface 15 of a grinding wheel 13 can be selected in a relatively simple manner and that such sharpness profile need not be constant in each and every section of the working surface but can vary from section to section if such variations of the sharpness profile are desirable or necessary for proper grinding of workpieces. All that is necessary is to properly select and (if necessary) vary the velocity of the point WP of contact between the dressing tool and the working surface of the grinding wheel while the grinding wheel rotates about its axis in the course of the dressing operation. The sharpness profile (coarseness of the working surface) can vary gradually from section to section of the working surface, or the transition can be more or less pronounced. Regulation or variation of the velocity $v_a$ and/or $v_r$ in order to achieve a desired velocity $\underline{v}$ of the point WP can be carried out in a relatively simple and inexpensive way. It is presently preferred to dress relatively steep sections of the working surface 15 in such a way that they are rougher than the other sections; this ensures that grinding with the thus roughened steeper sections of the dressed working surface entails the generation of less heat which is desirable and advantageous because it ensures gentler treatment of the workpieces.

Another important advantage of the improved method is that the final profile of the working surface matches or very closely approximates the desired or optimum profile. This is due to the fact that the path of the point WP can be altered in the course of the dressing operation. A grinding tool whose working surface exhibits a desired or optimum profile is subject to less pronounced wear, and the number of defective workpieces is also reduced.

As used herein, the term "sharpness profile" is intended to denote the progress of sharpness of the working surface, i.e., a composite sharpness including the sharpnesses of all sections of the dressed working surface.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim;

1. A method of imparting to the working surface of a grinding wheel a predetermined sharpness profile in the course of path-controlled dressing of the working surface with a dressing tool which contacts the working surface in the course of the dressing operation, comprising the steps of rotating the grinding wheel about its axis; moving the grinding wheel and the dressing tool relative to each other along the desired profile in a first direction and in a second direction substantially transversely of said first direction; and varying the velocity of movement in at least one of said directions in the course of the dressing operation in accordance with a predetermined pattern while the dressing tool is in contact with the working surface.

2. The method of claim 1, wherein one of said directions has a component which is parallel to the axis of the grinding wheel.

3. The method of claim 1, wherein the working surface of the grinding wheel is substantially in a point contact with the dressing tool in the course of the dressing operation, said moving step including varying the velocity of movement of the point of contact between the working surface and the dressing tool along its path in the course of the dressing operation.

4. The method of claim 1, wherein said varying step includes varying the velocity of movement in said at least one direction as a function of the configuration of the working surface of the grinding wheel.

5. The method of claim 1, wherein the axis of the grinding wheel is parallel to said second direction and said varying step includes varying the velocity of relative movement of the grinding wheel and dressing tool in said first direction.

6. The method of claim 1, wherein the working surface of the grinding wheel is substantially in a point contact with the dressing tool, and further comprising the steps of selecting for the point of contact between the working surface and the dressing tool a predetermined path for movement in the course of the dressing operation, generating signals denoting the predetermined path and regulating said moving step in said at least one direction as a function of said signals.

7. The method of claim 6 further comprising the steps of monitoring the relative movements of the grinding wheel and the dressing tool to ascertain the actual path of movement of the point of contact between the working surface and the dressing tool on the basis of the results of the monitoring step, comparing the predetermined path with the actual path and generating correction signals denoting deviations of the actual path from the predetermined path, said regulating step including adjusting the moving step as a function of said correction signals so as to eliminate said deviations.

8. The method of claim 1 of imparting a predetermined sharpness profile to the working surface of a grinding wheel wherein at least a section of the working surface has a pronounced inclination relative to the axis of the grinding wheel, further comprising the step of changing the orientation of the dressing tool relative to the grinding wheel during dressing of such section of the working surface.

9. The method of claim 8, wherein the dressing tool includes a flank which makes with said section of the working surface a predetermined angle prior to said orientation changing step and said orientation changing step includes increasing said angle so that the thus increased angle exceeds a preselected minimum value.

10. A method of imparting to the working surface of a grinding wheel, wherein the profile of the working surface has a section which is inclined relative to the axis of the grinding wheel, a predetermined sharpness profile in the course of path-controlled dressing of the working surface with a dressing tool which contacts the working surface in the course of the dressing operation, comprising the steps of rotating the grinding wheel about its axis; moving the grinding wheel and the dressing tool relative to each other along the desired profile in a first direction and in a second direction substantially transversely of said first direction; and varying the velocity of movement in at least one of said directions in the course of the dressing operation in accordance with a predetermined pattern, including varying the velocity of movement in said at least one direction as a function of the extent of inclination of said section of the profile of the working surface relative to the axis of the grinding wheel.

11. The method of claim 10 wherein said varying step includes increasing the velocity of movement in said at least one direction when the extent of inclination of said section of the profile of the working surface relative to the axis of the grinding wheel increases and vice versa.

* * * * *